US005873650A

United States Patent [19]

Luk et al.

[11] Patent Number: 5,873,650

[45] Date of Patent: Feb. 23, 1999

[54] MODULAR HEAT SINK ADAPTER FOR LAMP BASES

[76] Inventors: John F. Luk, 55-19 96th St., Corona, N.Y. 11368; Robert S. Kliegl, 266 Burns St., Forest Hills, N.Y. 11375

[21] Appl. No.: 746,976

[22] Filed: Nov. 19, 1996

[51] Int. Cl.[6] ..... F21V 29/00

[52] U.S. Cl. ..... 362/294

[58] Field of Search ..... 313/42, 43, 45, 313/46, 30, 39, 40, 44; 362/294

[56] References Cited

U.S. PATENT DOCUMENTS

| | | | |
|---|---|---|---|
| 2,714,676 | 8/1955 | Machlett et al. | 313/40 |
| 3,645,600 | 2/1972 | Doctoroff et al. . | |
| 4,061,912 | 12/1977 | Levasseur . | |
| 4,780,799 | 10/1988 | Groh | 362/294 |
| 4,885,668 | 12/1989 | Maglica et al. . | |
| 4,985,815 | 1/1991 | Endo . | |
| 5,130,913 | 7/1992 | David . | |
| 5,138,541 | 8/1992 | Kano . | |
| 5,268,613 | 12/1993 | Cunningham et al. . | |
| 5,329,436 | 7/1994 | Chiu | 362/294 |
| 5,420,769 | 5/1995 | Ahlgren et al. | 362/294 |

OTHER PUBLICATIONS

Ushio America, Inc. Ushio Advertisement HPL Compact Filament Lamps (no date).

Ushio America, Inc. FLK/HX600 Ushio Advertisement Compact Filament Lamps (no date).

*Primary Examiner*—Elizabeth L. Dougherty

*Attorney, Agent, or Firm*—Lackenbach Siegel Marzullo Aronson & Greenspan

[57] ABSTRACT

A modular heat sink adapter (10) is provided which is compact in design and comprises of a highly heat conductive metal (12) with a varying number of extruded fins (14) for the prompt and efficient removal of heat directly off the lamp bases (36) of various types of halogen lamps (32). The primary purpose for the heat sink adapter (10) is to keep lamp base seals (38) from reaching their critical pinch area temperature, thereby prolonging the life and usefulness of the lamps. The major improvement of this device over prior designs is its versatility and ease of use with various types of halogen lamps (32) available from different bulb manufacturers for use in a variety of light fixtures.

18 Claims, 6 Drawing Sheets

MODULAR HEAT SINK ADAPTER FOR LAMP BASES

BACKGROUND

1. Field of Invention

This invention relates to heat absorbing devices, specifically to such devices which are used for extracting the heat radiation from the pinch area of several incandescent lamp bases.

2. Description of Prior Art

Improved incandescent lamps using tungsten filaments with a halogen type gas, both encapsulated in a quartz glass envelope have been around for many years. Halogen lamps give off considerable amounts of infrared radiation or heat energy. It is estimated that only 13% of the electrical energy going through a lamp filament will go towards actual light output. The remaining 87% is converted directly to heat energy.

Halogen lamps with short light center lengths (LCL) and greater lamp output power in excess of 400 watts or so, apply more heat stress to the lamp seal region. This so-called squeeze point or neck, is the physical area of constriction of the lamp located at the base of the lamp. Another term for this region is the pinch area. The pinch in a lamp is one of the most critical areas. It is the area of the quartz glass envelope that is sealed between the exterior of the envelope and the gas filled interior that houses the filament of the lamp. In this pinch area, two conductors carry the current in and out of the filament of the lamp. The electrical current subjects the pinch area to high temperatures. At high operating temperatures, oxidation of the filament lead-in and lead-out conductors, or slight mismatches between the coefficient of expansion of the quartz glass and these conductors will cause the pinch area to crack, and therefore compromise the effectiveness of the air-tight pinch. If the halogen lamp is overheated, the oxidation of the pinch will lead to premature lamp failure. For example, a halogen with an expected lamp life of 250 hours will have a maximum pinch area operating temperature of 400 degrees Celsius. Exceed the pinch area temperature of 400 degrees Celsius and the lamp will fail sooner. Obviously, a lamp will not burn forever. Ordinarily, the material in the filament evaporates in time, and will cause the filament to weaken and collapse. The filament may short together to create a hot spot. The hot spot in turn draws more current and will cause the filament to explode and break apart all together.

If overheating of the lamp can be avoided and the pinch area temperature is kept at the critical level of about 350 degrees Celsius or lower during normal use, the halogen lamp can be expected to last longer. There have been many attempts to devise a method to keep the pinch area temperature of a lamp below the critical level. Heat shields have been used in systems comprising of a lamp source, lamp socket, and reflector. The disadvantage here is that the heat shield was used to deflect the heat generated by the lamp source away from the reflector, lamp socket, or lamp housing, but did little or nothing to keep the lamp source cool. Other prior art have shown inventions suggesting or using heat sinks with fins attached to the rear surface of a reflector in a lamp housing. Again, the inventions cooled the reflector, but the lamp did not benefit directly from these designs. Yet, some inventions called for the cooling of the lamp source by attaching heat dissipating fins to the mount supporting the socket that holds the lamp, or to the socket itself. This again did not directly benefit the lamp and its critical pinch area, but cooled the socket more so. Lastly, present lamp sources with integral heat sinking and cooling fins manufactured as part of the lamp, do not provide convenient and modular use with a variety of other types of lamps with varying filament designs and layouts. The disadvantage here is that the lamps manufactured with integral heat sinks can only be used in light fixtures designed to accommodate such lamps, thereby limiting their usage.

OBJECTS AND ADVANTAGES

The object of the present invention is to provide an improvement over past inventions and designs, thus giving a more efficient means for heat removal from the pinch area of a halogen lamp base. This device will allow for the better cooling of the lamp's pinch area by absorbing the heat directly off the seal area of a lamp base onto cooling fins. The heat is then dissipated off the fins by air convection into the surrounding area. This will reduce the incidence of premature lamp failure due to overheating.

The primary advantage of the present invention is the versatility aspect of its design. The present invention is a modular and external adapter that holds the lamp base for proper lamp alignment. It can be used with a wide variety of halogen type lamps from different lamp manufacturers. The present invention will readily accept any G9.5 medium two-pin base lamps with a 9.5 mm spacing between the pins for use with a socket and socket assembly that will accept such type of lamps. It can be used in most any lighting fixture that allows a heat sink to be attached directly to the base of the lamp source for the efficient cooling of the entire lamp pinch area. The present invention has been so designed for modular use for the temporary mounting to a socket assembly and lamp source at any given time if so desired. Therefore, it is not permanently mounted to a socket or socket assembly, nor is it permanently attached to a reflector or reflector assembly. The present invention can even stay together with the lamp source at all times if so desired.

The usefulness of the present invention will be found to be that the modular heat sink adapter is simple in design, and can be made rather quickly and at a relatively low cost. Materials such as aluminum can be easily formed to create elaborate heat sink configurations with cooling fins. Heat absorbing devices made from such lightweight materials such as aluminum are easily handled both in manufacturing and installation.

DRAWING FIGURES

For a better understanding of the invention, its operating advantages and specific objects attained by its uses, reference is made to the accompanying drawings and descriptive matter in which preferred embodiments of the invention are illustrated. In the drawings.

Reference Numerals in Drawings

| | |
|---|---|
| 10 heat sink adapter | 12 metallic substrate |
| 14 cooling fins | 16 spacing between fins |
| 18 surrounding ambient air | 20 mounting plate |
| 22 center hole on plate | 24 mounting holes on plate |
| 26 center hole on adapter | 28 mounting holes on adapter top |
| 30 screws, rivets, etc. | 32 medium 2-pin base lamp |
| 34 outer metal lamp base housing | 36 base of lamp |
| 38 pinch area | 40 flared lip of outer housing |
| 42 concave cavity on lamp base | 44 transparent glass envelope |
| 46 tungsten filament | 48 pin 1 of lamp |
| 50 pin 2 of lamp | 52 halogen gas atmosphere |
| 54 conductive lead wires | 56 spring mechanisms |
| 58 mounting holes on adapter sides | |

DESCRIPTION AND OPERATION—FIGS. 1 to 6

The present invention will be described herein below by way of example only with reference to a preferred embodiment.

Figure 1:
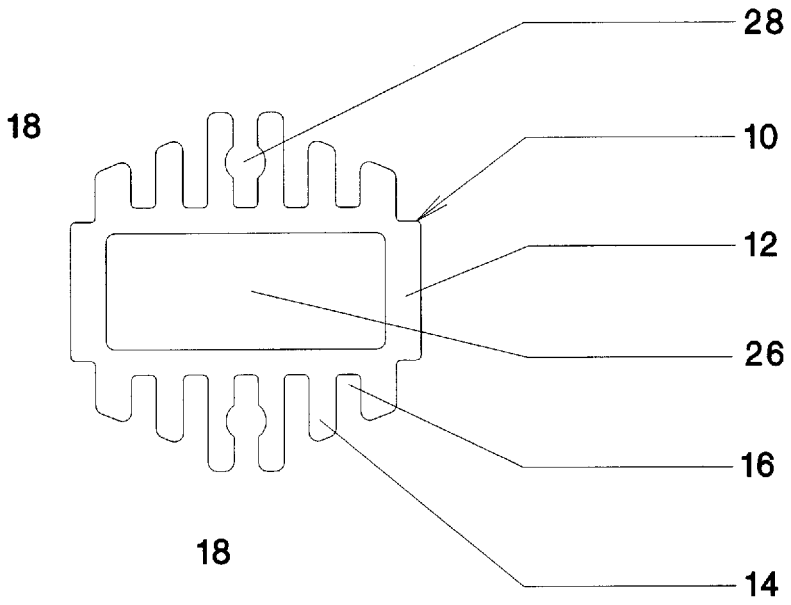
FIG. 1 is a sectional view of the device in a preferred embodiment according to the present invention.
Figure 2:
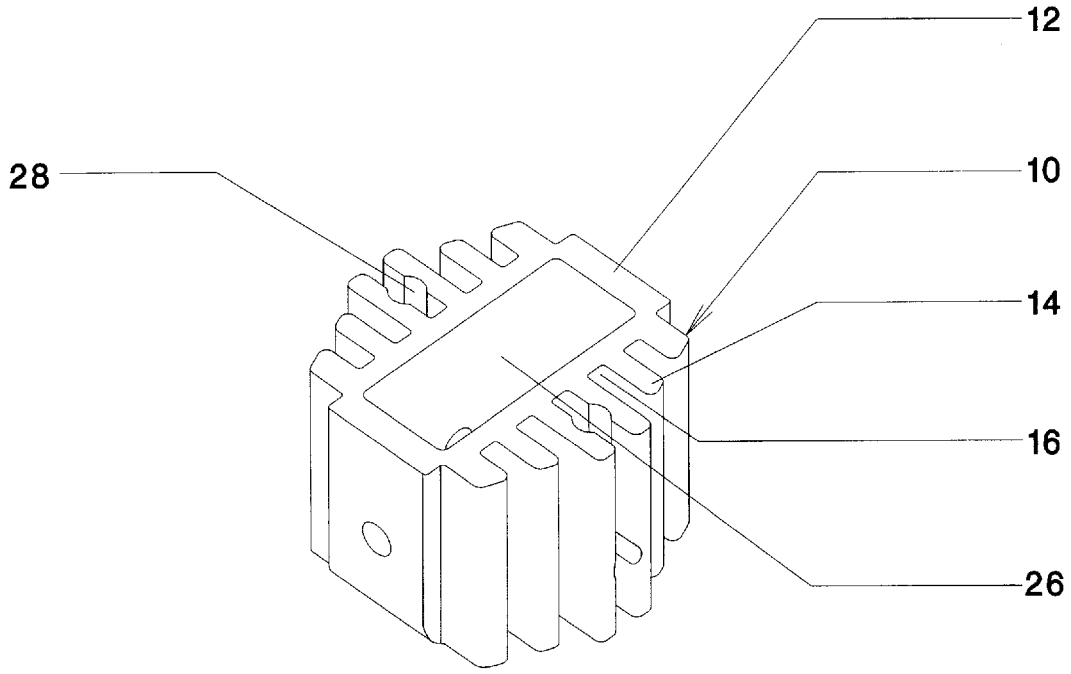
FIG. 2 is a perspective view of the device of FIG. 1.

Referring to the drawings, and particularly to FIGS. 1 and 2, a heat sink adapter 10 is made of a metallic substrate 12, preferably out of aluminum or an aluminum alloy material. Aluminum is generally desired as the material of choice for adapter 10 because it is inexpensive, is an excellent conductor of heat, and is highly ductile for easy manufacturing by such processes as stamping, cold forming, and hot forming as in extrusions and die castings. It can be appreciated, that other materials like aluminum, which function to provide easy forming and possess excellent heat conduction properties may be used in the present invention.

Heat sink adapter 10 can be easily manufactured by hot forming to create an aluminum extrusion of the present embodiment. Lengths of aluminum extrusion with fins 14 are used to make heat sinks. Aluminum logs are heated to a liquid state, and are then extruded under high heat and pressure through a die with openings that give the desired cross-section of the present invention of the preferred embodiment. The extrusion can then be cut to different lengths as desired by the particular application. The individually cut extrusion pieces form the basis for heat sink adapter 10.

Heat sink adapter 10 includes a plurality of heat radiating ribs or fins 14 that extend away from one or more sides of the adapter wall, and extending outward from the center 26 of adapter 10 in equal and/or unequal lengths. The fins 14 on a heat sink made from an aluminum extrusion may or may not necessarily run parallel with the length of the original stock. As a rule, if the extruded fins are running parallel to the length of the original stock, the height of adjacent parallel fins cannot be longer than four times the width of the spacing 16 between the fins 14 at the narrowest point. The risk of tool breakage is increased if the ratio is greater than four. Fins 14 are so designed as to provide the maximum amount of surface area for air cooling 18. Although it is preferred to have adapter 10 configured such that heat is transferred to fins 14, other acceptable heat sink configurations may be made which do not provide for the direct transfer of heat to fins 14, but rather have other sufficient means to act as the heat sink, or will transfer heat to some other remote component which acts as the heat sink.

Figure 3:
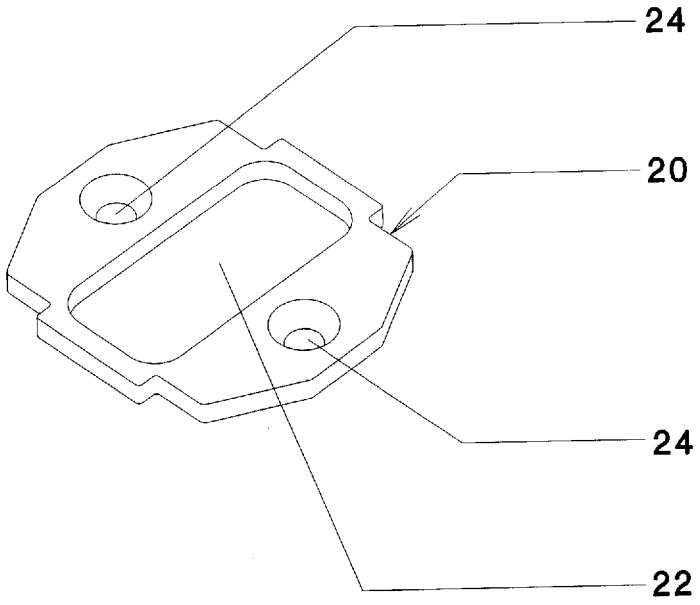
FIG. 3 is a perspective view of a mounting plate for use with the preferred embodiment of the present invention.
Figure 4:
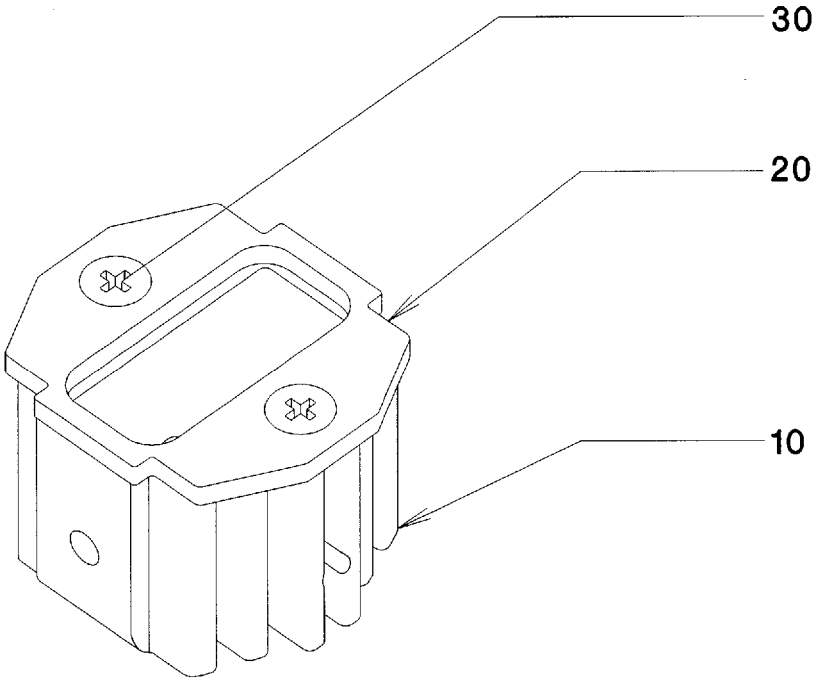
FIG. 4 is a perspective view of the device with the mounting plate according to resent invention.

Now referring also to FIG. 3, a separate mounting plate 20 can be used with the preferred embodiment of this invention. Mounting plate 20 can be formed by the cold metal stamping of aluminum sheets, or by extruding as well. Aluminum plate 20 contains a center hole opening 22, and holes 24 for mounting onto extruded heat sink adapter 10. The adapter 10 has a smaller center hole opening 26 than mounting plate. Holes 28 are also provided on adapter 10 for the proper and secured mounting of plate 20 to adapter 10 as illustrated in FIG. 4. Screws, rivets, and other hardware 30, or welding and use of high-temperature adhesives may be employed to secure the plate 20 to adapter 10. In the example illustrated in FIG. 5, a G9.5 medium 2-pin base lamp 32 usually has an aluminum outer shell 34 housing the lamp base 36 that contains the pinch region 38. Outer shell 34 will usually have a flared lip 40 at the top of lamp base 36. A concave cavity or indented area 42 can be found on either side of lamp base 36, roughly ⅓ the way up from the bottom of lamp 32 where the two pins 48 and 50 are attached to the tungsten filament 46. Concave cavity or indented area 42, provide a location for the positive locking of lamp 32 to a socket, socket adapter, or in this case, to adapter 10. Thus, according to FIGS. 4 and 6, the purpose for mounting plate 20 is to provide a compliance fit for various lamp base packages, and to provide a convenient lip for an end-user to insert and remove adapter 10 from a socket or socket assembly. Mounting plate 20 can also be used to remove lamp 32 from a socket or socket assembly by just grasping adapter 10 and lifting without the need to handle the lamp 32 or any part thereof. The exemplary embodiment of FIG. 4, is shown in a generally octagonal configuration. It can be appreciated, however, that a great deal of other configurations may be used according to the principles of the present invention, depending only upon the particular application for the proposed heat sink adapter.

Referring back to FIG. 5, a typical 2-pin base lamp 32 is shown. Lamp 32 is shown having a transparent glass envelope or bulb 44, filament 46, and pins 48 and 50 for providing a source of light. Lamp 32 includes an envelope 44 with a pinch sealed end 38 from which a pair of conductive lead wires 54 are electrically coupled to filament 46 located within the lamp's envelope 44. The coil filament 46 is made of tungsten wire, and the atmosphere 52 contained within envelope 44 includes a halogen or similar type gas. Tungsten halogen lamps are well known in the art. One example of a halogen lamp which can be used in the present invention is referred to in the industry as a G9.5 medium 2-pin base lamp. Such lamps typically include a tungsten filament structure 46, either of a single coiled, bi-planar, or other filament design and layout configuration. The lamp's envelope or bulb portion 44 is filled with a halogen or similar atmosphere 52 which may or may not be under pressure. Such gas-filled lamps produce a relatively bright light with high temperatures at the filament 46, envelope 44, and pinch area 38. Lamps of this variety are also often referred to under ANSI code designations as EHD, EHG, FEL, FEP, FLK, GKV, HX400, HX401, HX600, HX601, HX602, etc. They are available from various lamp manufacturers like GE Thom, Philips, and Ushio, etc. These lamps are otherwise referred to as high wattage lamps, typically operating at a wattage range from about 400 to 1000 watts with operating voltages of 100 to 240 VAC, and have operating color temperatures of approximately 3100 to 3300 degrees Kelvin at typical lamp outputs of 16500 lumens. In addition, such lamps have a typical average life of about 150 to 300 hours. The present invention may be used in conjunction with other types of lamps by the simple modification to the center hole opening to accommodate different lamp base dimensions.

Figure 5:
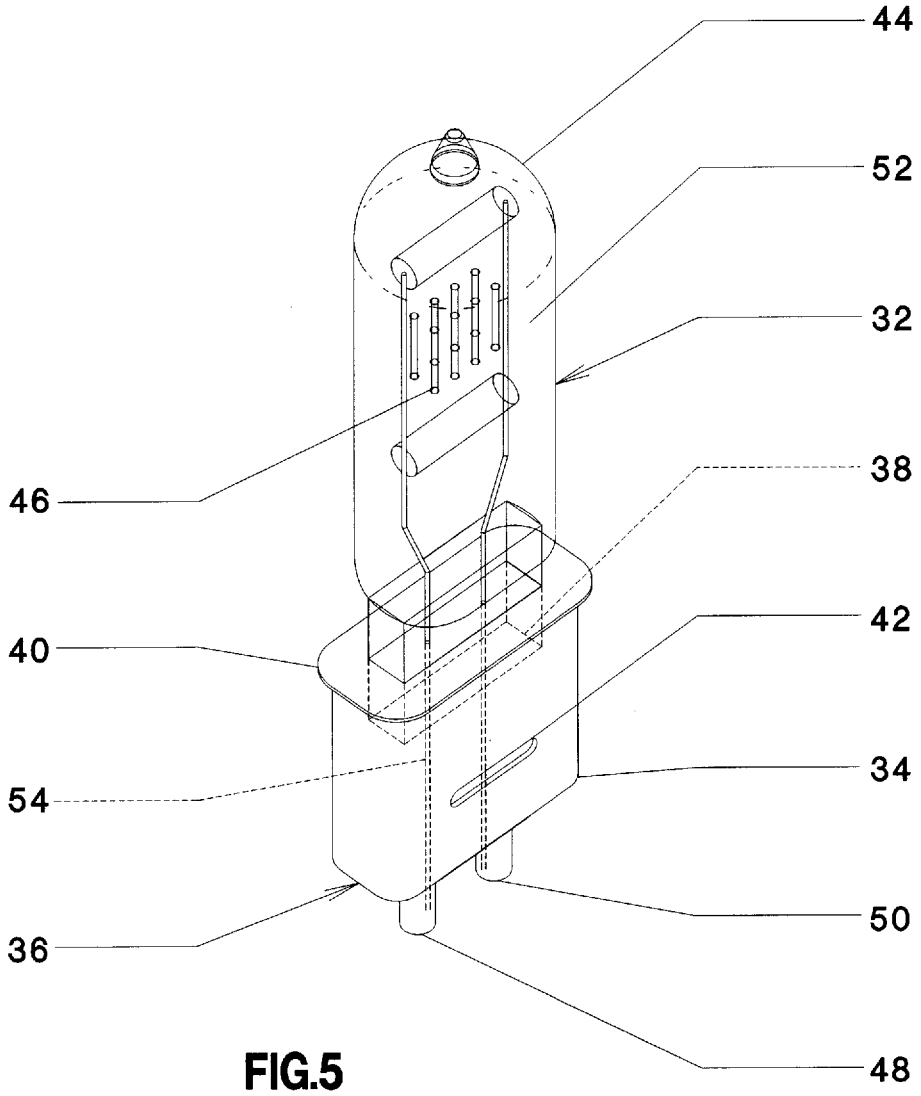
FIG. 5 is a perspective view of a lamp for use with the preferred embodiment of resent invention.
Figure 6:
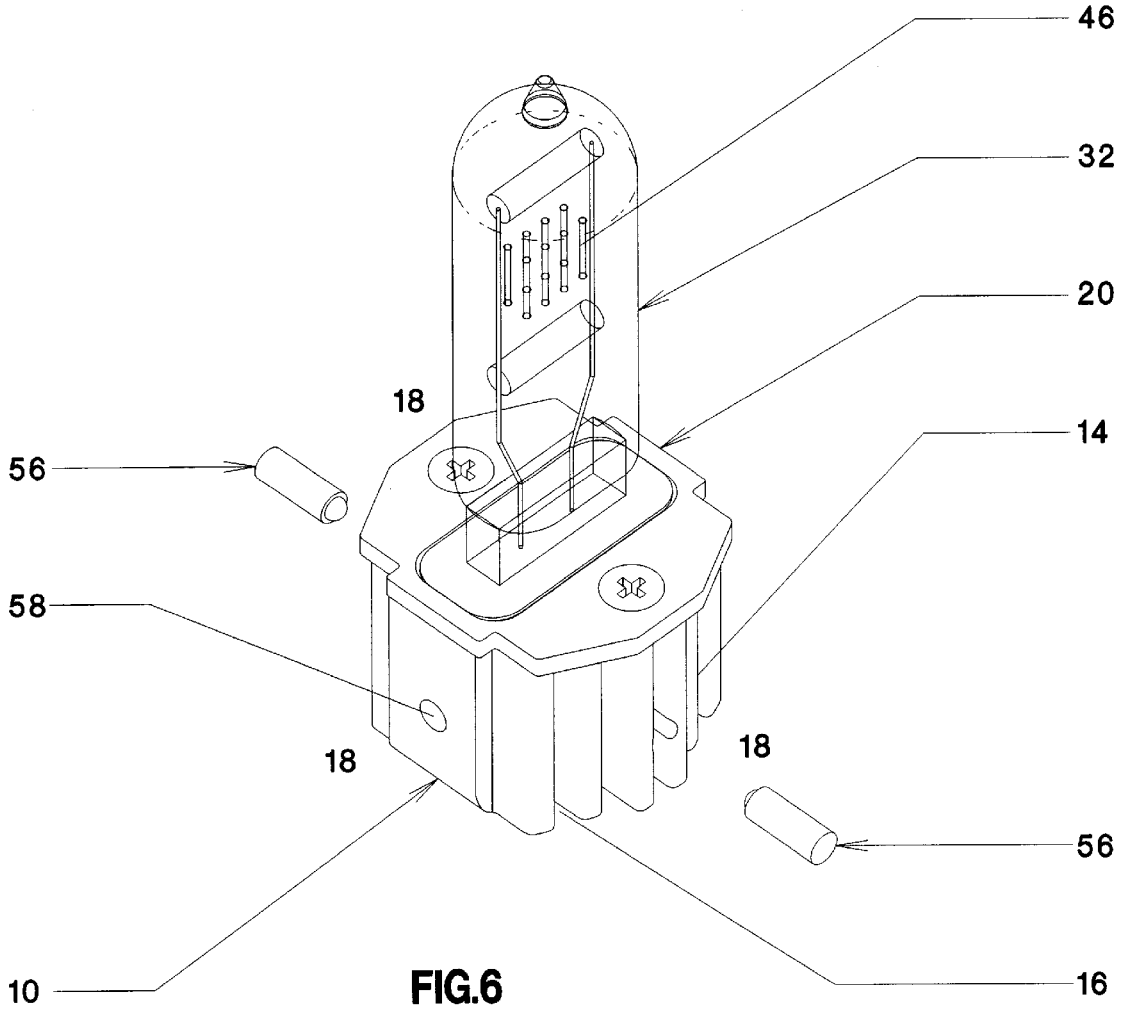
FIG. 6 is a perspective view of a lamp within the device according to the present invention.

Referring now to FIGS. 5 and 6, the lamp 32 is inserted into heat sink adapter 10, and is independently supported by adapter 10 at the sides of lamp base 36 by one or more spring tabs. Spring tabs may be substituted with one or more spring actuated ball plungers 56, or a similar mechanism that puts positive locking force onto cavity 42 provided by the lamp bases of the medium 2-pin base lamps. One source for ball plungers is VLIER ENERPAC Production Automation in Burbank, Calif., the makers of the original VLIER pin. Ball plunger 56 holds lamp 32 securely in place, and provides proper filament 46 alignment within adapter 10 of the present invention. The proper alignment of lamp 32 within adapter 10 is essential in order to assure optimum light output when used in conjunction with a socket and reflector assembly within a light fixture with or without optical lenses. In addition, there are provisions on adapter 10 itself for mounting the adapter onto a socket or socket assembly. These provisions are in the form of holes or recessed cavities 58 on at least one side of adapter 10. Examples of light fixtures with the above properties include the Source Four, the Source Four Par, and the Source Four Jr. line of fixtures manufactured by Electronic Theatre Controls of Middleton, Wis.

When lamp source 32 is energized, the heat radiation waves are readily absorbed by adapter 10 because of the high thermal conductivity of such materials as aluminum, which for the purposes of this invention is a particularly desirable property. The generally rapid conduction of heat, theoretically and uniformly heats adapter 10. Since the primary function of heat sink adapter 10 is to absorb heat radiation waves, adapter 10 is preferably of a suitable thickness for absorbing heat without distortion. The heat is further conducted onto fins 14 attached to adapter 10, and is dissipated from adapter 10 through convection into the surrounding air 18 by way of fins 14. The heat from the lamp is removed by natural convection by the air 18 circulating between air space 16 and fins 14 into the air 18 that surrounds heat sink adapter 10.

SUMMARY, RAMIFICATIONS, AND SCOPE

The pinch area temperature during normal operation should be around 350 degrees Celsius. Actual temperature readings done on various lamps in different light fixtures, all showed a drop in pinch area temperature of more than twenty-five percent when the lamps were used with the heat sink adapter. This was accomplished by providing a modular heat sink adapter that was so constructed, and so located as to protect the lamp base from the convection heat and radiation heat generated by the light source. The heat sink adapter allowed for the better cooling of the lamp's pinch area by absorbing the heat directly off the seal area of the lamp base and onto cooling fins. The heat was then dissipated off the fins by air convection into the surrounding area. All these tests were performed with identical operating conditions, and all the lamps tested had integral thermocouple leads attached to the pinch area of their respective lamp bases.

It will be understood by a person skilled in the art that the above described embodiments may be constructed with numerous alterations and equivalent features, all of which are intended to be covered by the scope of the present invention. Many other variations are possible. For example, the heat sink adapter may be formed of an aluminum or aluminum alloy die casting. A separate mounting plate is not needed here because the advantages presented by the previously mentioned plate are molded directly into the die casting. Another embodiment of the present design may consist of two or more metallic substrate parts that come together to form a single and complete heat sink adapter to be used with different lamps. The natural color of aluminum is satisfactory and does not affect the function of the present invention. The heat sink adapter can be anodized or otherwise dyed in different colors to make the invention more attractive to suit persons with varying tastes.

The above disclosed embodiments are not intended to limit the invention, but rather to illustrate preferred embodiments within the scope of the present invention. While specific embodiments of the invention have been shown and described in detail to illustrate the application of the principles of the present invention, it will be understood that the invention may be further embodied without departing from such principles.

The various features of novelty, usefulness, and unobvious features, shown or described which characterize the present invention, are pointed out with particularity in the appended claims and their legal equivalents annexed to and forming part of this

What we claim is:

1. A heat absorbing/dissipating device, for use with halogen lamps or the like, in combination with a generally high wattage lamp of a lighting fixture for absorbing/dissipating heat generated by said lamp, having an envelope portion, containing at least one filament with a pinch/seal area, housing a pair of conductors connected to said at least one filament, and being connected to a lamp base disposed thereabout with electrically conductive connecting pins at an end of said lamp base for mating with an electrical socket, comprising:

a generally polygonal-shaped, reusable conductive adapter of a high thermal conductive metallic material of absorbing heat radiation waves, and having sidewalls and top and bottom sides, and a rectangular aperture of a size to accommodate said lamp base with said aperture extending through said adapter from said top side to said bottom side, and said adapter further having a plurality of inner side surface areas juxtaposed said pinch/seal area for maximum heat transfer, and a plurality of outer side surface areas, some of which comprise a plurality of integrally formed fins extending outwardly therefrom, and two of which form a pair of said sidewalls with generally parallel surfaces; and whereby said reusable conductive adapter is adapter is repeatedly reusable with new lamps when said lamp is "burned out", and further provides handy, relatively cool, gripping areas for a user to grab when inserting and/or removing said lamp from the lighting fixture while maintaining the temperature of the lamp base pinch/seal area from reaching its critical pinch/seal area temperature due to said pinch/seal area of said lamp being surrounded by and in proximate relationship to said sidewalls of said adapter.

2. The heat absorbing/dissipating device according to claim 1, wherein said adapter further having means for securing said lamp base to said adapter.

3. The heat absorbing/dissipating device according to claim 2, wherein said means for securing said lamp base to said adapter is secured to a sidewall of said adapter, and comprises at least one resilient member which bears against a side of said lamp base.

4. The heat absorbing/dissipating device according to claim 3, wherein said resilient member is a spring-loaded bearing element for maintaining a pressure "bearing" face against said lamp base.

5. The heat absorbing/dissipating device according to claim 3, wherein said spring-loading bearing element is a Vlier pin.

6. The heat absorbing/dissipating device according to claim 1, further including a plate, having a rectangular aperture generally of about the same size and shape as that of said aperture of said adapter except slightly wider and longer, and being securable to said adapter; and said plate further facilitating placement and removal of said lamp from a socket or socket assembly of a lighting fixture.

7. The heat absorbing/dissipating device according to claim 6, wherein said plate and said adapter when mounted together form a small peripheral ledge on said top side of said adapter for mating with a lip flaring outwardly at an end of said lamp base opposite to said end of said lamp base having said connecting pins;

whereby the cooling of said pinch/seal area of said lamp is significantly improved as heat is absorbed directly off said pinch/seal area of said lamp base and unto said plurality of fins of said adapter.

8. The heat absorbing/dissipating device according to claim 6, wherein said adapter and said plate are made as a unitary one-piece construction.

9. The heat absorbing/dissipating device according to claim 6, wherein said unitary one-piece construction is made of an aluminum die-casting.

10. The heat absorbing/dissipating device according to claim 1, wherein said plurality of fins have gaps therebetween, and said fins are generally parallel to each other and on the sidewalls of said adapter between said pair of sidewalls having generally parallel surfaces.

11. The heat absorbing/dissipating device according to claim 10, wherein said plurality of fins comprise a total of twelve, with six each on said sidewalls of said adapter between said pair of sidewalls having generally parallel surfaces.

12. The heat absorbing/dissipating device according to claim 11, wherein said plurality of fins of each of said sidewalls are symmetrical and vary in depth.

13. The heat absorbing/dissipating device according to claim 12, wherein a pair of central fins have about the same surface area, and adjacent fins decline in surface area with the fins closest to said pair of generally parallel surfaces being the smallest in size.

14. The heat absorbing/dissipating device according to claim 1, wherein said aperture in said adapter is uniformly rectangular in shape in any plane taken transverse to said aperture.

15. The heat absorbing/dissipating device according to claim 1, wherein said adapter has generally a peripheral shape of octagonal configuration.

16. The heat absorbing/dissipating device according to claim 1, wherein said lamp is a high wattage lamp ranging from about 400 to about 1000 watts, and having operating voltages of about 100 to about 240 volts AC.

17. The heat absorbing/dissipating device according to claim 1, further including on at least one side of said sidewalls of said adapter an aperture/cavity for mating of said adapter onto a socket or socket assembly of a light fixture, selected from the group consisting of light fixtures known as Source Four, Source Four Jr. and Source Four Par made and/or sold by Electronic Theater Controls of Middleton, Wis.

18. The heat absorbing/dissipating device according to claim 1, wherein said adapter is made of a metal selected from the group consisting of aluminum, aluminum alloys, and other conductive metals capable of being fabricated by die-casting.

* * * * *